US005924606A

United States Patent [19]

Huizing

[11] Patent Number: 5,924,606

[45] Date of Patent: Jul. 20, 1999

[54] POURING SPOUT WITH REFILL PREVENTION DEVICE

[75] Inventor: Hendrik Gezinus Huizing, Enschede, Netherlands

[73] Assignee: Hoytink Holding B.V., Plasmolen, Netherlands

[21] Appl. No.: 08/809,265

[22] Filed: Apr. 29, 1997

[30] Foreign Application Priority Data

Sep. 14, 1994 [NL] Netherlands ..... 9401491

[51] Int. Cl.[6] ..... B65D 5/72

[52] U.S. Cl. ..... 222/500; 222/147; 215/22

[58] Field of Search ..... 222/147, 500; 215/18, 21, 22

[56] References Cited

U.S. PATENT DOCUMENTS

| | | | |
|---|---|---|---|
| 2,021,562 | 11/1935 | Martin . | |
| 2,061,603 | 11/1936 | Ward . | |
| 2,400,730 | 5/1946 | Archidiacano . | |
| 2,835,411 | 5/1958 | Scheminger, Jr. | 222/147 |
| 3,386,626 | 6/1968 | Kearney | 222/147 |
| 3,484,819 | 12/1969 | Tanner | 222/500 X |

FOREIGN PATENT DOCUMENTS

| | | | |
|---|---|---|---|
| A2444621 | 7/1980 | France . | |
| 331534 | 8/1935 | Italy | 222/500 |
| A7500832 | 7/1975 | Netherlands . | |
| AP9201043 | 1/1994 | Netherlands . | |
| AP3639 | of 1915 | United Kingdom . | |
| A470207 | 9/1937 | United Kingdom . | |

*Primary Examiner*—Gregory L. Huson
*Attorney, Agent, or Firm*—Webb Ziesenheim Logsdon Orkin & Hanson, P.C.

[57] ABSTRACT

A pouring spout for an opening in a container includes a pouring spout housing with at least one opening and a hollow cylinder member which is displaceable in an axial direction relative to the pouring spout housing between a closing position in which the cylinder member closes the opening in the pouring spout housing and a pouring position in which the opening is left clear.

18 Claims, 3 Drawing Sheets

POURING SPOUT WITH REFILL PREVENTION DEVICE

BACKGROUND OF THE INVENTION

1. Field of the Invention

The invention relates to a pouring spout for an opening in a container. Particularly envisaged here are containers in the form of bottles, i.e. bottles which are used for containing liqueur and other strong drinks.

2. Description of the Prior Art

Pouring spouts known up until the present contribute to a luxury image of the container (bottle). The pouring spout must also facilitate pouring and, when the container is not in the pouring position, prevent liquid from outside of the container being introduced into the container through the pouring spout.

An example of such a pouring spout, which are also designated "non-refillables", is the ball closure as described in the Netherlands patent application 9201043 in the name of the present applicant. Described therein is a pouring spout in which a free space is created in which a ball is movable and wherein a roll-off surface is also arranged converging toward the container for co-action with the ball. In the vertical position of, for example, a bottle the ball will be guided by the roll-off surface to a central opening, whereby this latter is closed by the ball. Such a construction has the drawback that it is relatively simple to push aside the ball by means of for instance a pin or a vibrating liquid flow. It is then simple to introduce liquid into the container from outside the container. Another drawback to this construction is that the liquid flow leaving the container during pouring enters the pouring spout via a central opening, whereafter the flow of liquid is then impeded inter alia by the ball body which is likewise situated in the pouring spout.

The present invention has for its object to provide an improved pouring spout which further obstructs refilling of a container, even in for example the horizontal position of a bottle, but the pouring properties of which are also better than those of the pouring spouts known in the prior art.

SUMMARY OF THE INVENTION

The present invention provides for this purpose a pouring spout for an opening in a container, that includes a pouring spout housing with at least one opening and a hollow cylinder member which is movable relative to the pouring spout housing in an axial direction between a closing position in which the cylinder member closes off the opening in the pouring spout housing and a pouring position in which the opening is left clear. In one embodiment of the present invention a guide part of the pouring spout housing guiding the hollow cylinder member is formed by a hollow cylindrical part which is closed on one end side and the casing of which is provided with at least one opening. In the case of this pouring spout the opening through which the liquid leaves the container is not situated in the centre of the spout but is placed off-centre. A more uniform flow is thereby created. The cylinder member also makes it possible to keep the opening closed in a horizontal position of, for example, a bottle.

When the cylindrical part of the pouring spout housing is provided with multiple openings distributed over the periphery of the casing, the pouring properties of the pouring spout are improved still further.

The pouring spout preferably includes comprises means for respectively opening and closing the opening in a determined position of the container. Depending on the chosen embodiment these means can be formed for instance by a weight which is movable in the pouring spout housing and which can then take the form of a sphere, or by a cylinder member which is weighted. By means of the force of gravity acting on respectively the opening and closing means, the cylinder member is moved relative to the pouring spout housing. Depending on the means selected, the closing force for instance can be determined herewith.

In another embodiment of the present invention the inside of the pouring spout housing includes a contact surface for the weight which diverges toward the cylindrical part. In yet another embodiment the outside of the cylindrical part of the pouring spout housing converges toward a side of the container opposite the opening of the container. By determining the shape of the contact surface with the opening and closing means respectively it is possible to determine at what angle the pouring spout must be situated in order to cause displacement of the cylinder member.

Of the structural properties discussed in the above stated embodiments two main embodiments will be described further; a preferred embodiment wherein the cylinder member is situated on the inside of the cylindrical part of the pouring spout housing and a preferred embodiment wherein the cylinder member is situated on the outside of the cylindrical part of the pouring spout housing. One of the two embodiments can be chosen subject to the specifications for use and the other properties of the pouring spout.

BRIEF DESCRIPTION OF THE DRAWINGS

The present invention will be elucidated further with reference to the non-limitative embodiments shown in the following figures.

DESCRIPTION OF THE PREFERRED EMBODIMENTS

Figure 1:
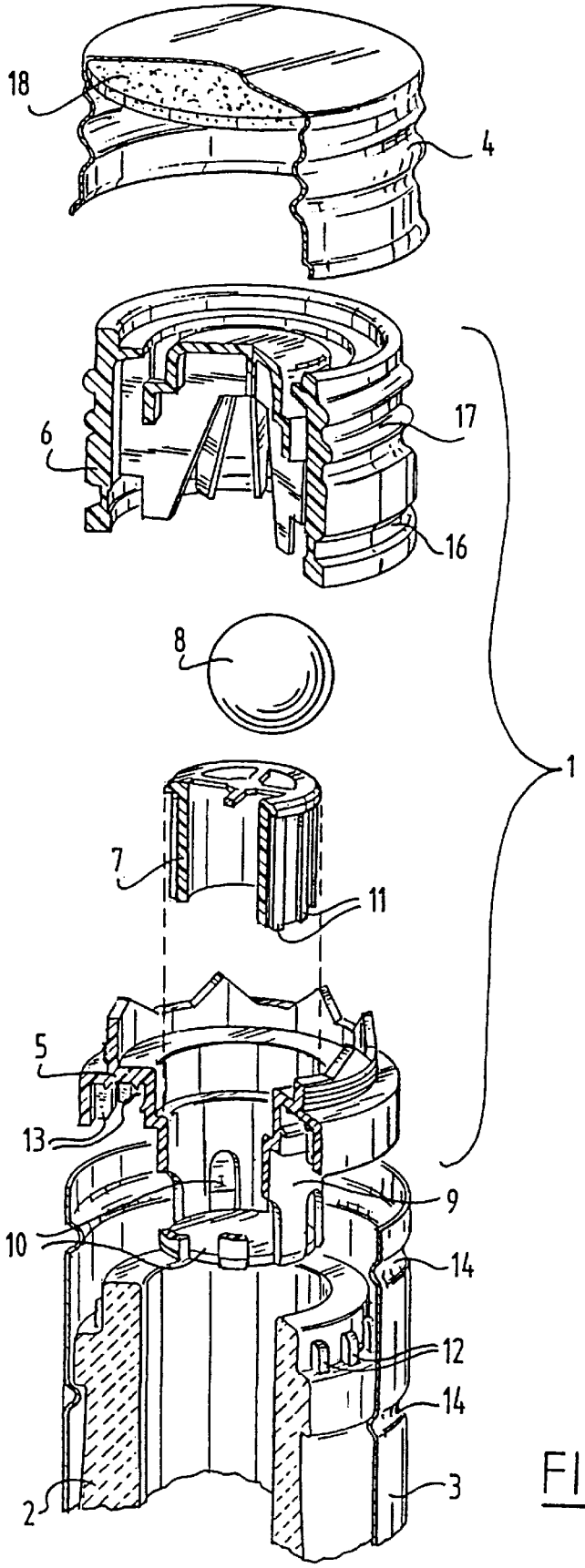
FIG. 1 is an exploded sectional view of a pouring spout according to the invention positioned on a bottle neck.

FIG. 1 shows a pouring spout 1, separated into a plurality of parts, in combination with a bottle-neck 2 on which the pouring spout 1 can be fixed. The figure also shows a capsule consisting of a neck part 3 and a closing part 4. The pouring spout 1 comprises a pouring spout housing formed from two parts 5, 6 in which a cylinder member 7 and a movable weight 8 are arranged. The cylinder member 7 is movable in a cylindrical part 9 of the pouring spout housing formed by the two parts 5, 6. Arranged round the periphery in the cylindrical part 9 are the casing openings 10 which can be left clear or closed off by moving the cylinder member 7. Guide ribs 11 are arranged on the outside of the casing of the cylinder member 7 for relatively easy displacement of the cylinder member 7 relative to the cylindrical part 9. When the pouring spout 1 is fixed onto the bottle-neck 2 it will not be possible to turn the spout relative to the bottle-neck 2 due to protrusions 12 and elevations 13 forming part of the pouring spout 1 and co-acting therewith. Due to constrictions 14 arranged in the neck part 3 which co-act respectively with a groove 15 in the bottle-neck 2 and a groove 16 in pouring spout 1, the latter cannot be taken off the bottle-neck 2. In the still unopened situation of the capsule the closing part 4 of the capsule is generally connected to the neck part 3 of the capsule. After being opened once this connection is broken, whereby it functions as seal. After being opened at least once the closing part 4 of the capsule can be fixed to the pouring spout 1 provided with an external screw thread 17. In the closing part 4 of the capsule is arranged an insert piece 18 of preferably resilient material for medium-tight closing of the pouring spout 1.

Figure 2:
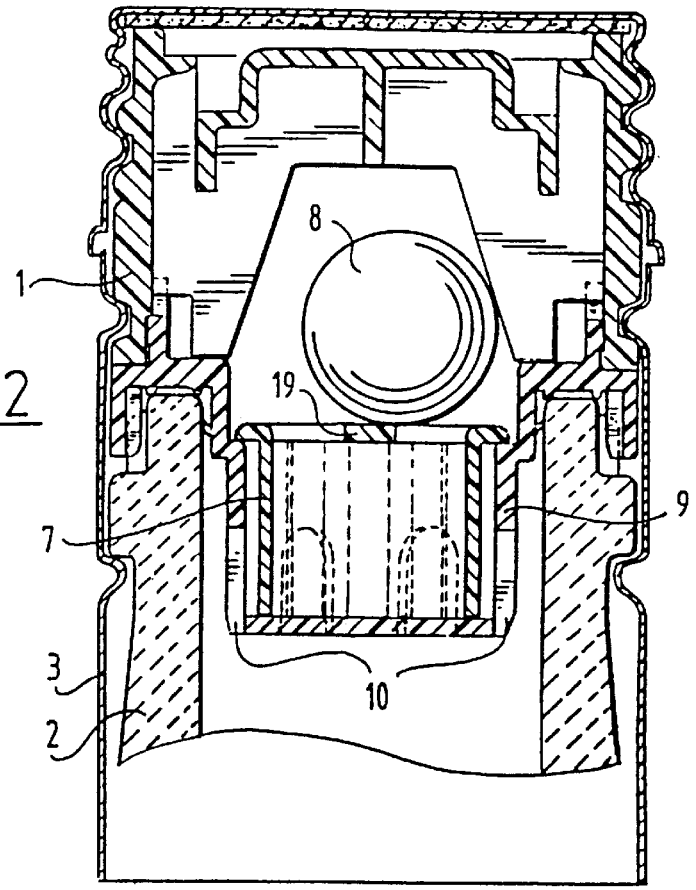
FIG. 2 is a cross-sectional view of the pouring spout of FIG. 1 vertically oriented.

FIG. 2 is a cross-sectional view of the pouring spout 1 shown in FIG. 1 in assembled state with the bottle-neck 2 and the capsule 314. The force of gravity exerted on ball-shaped weight 8 is transmitted substantially to the cylinder member 7. In order to prevent the ball-shaped weight 8 from falling into the cylinder member 7 or closing the central opening thereof, the top side thereof is provided with grid bars 19, only one of which is visible in this figure. The force exerted on the cylinder member 7 presses the cylinder member 7 into the cylindrical part 9 of the pouring spout 1 provided with openings 10. The openings 10 are closed in this manner.

Figure 3:
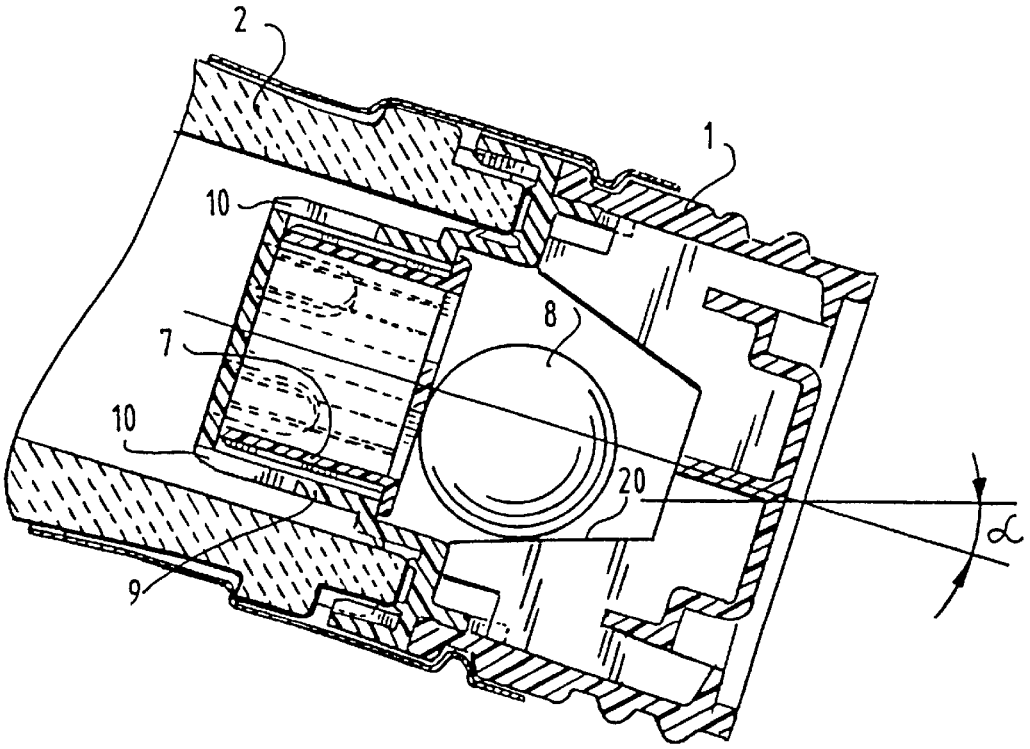
FIG. 3 is the pouring spout of FIG. 2 tilted relative to the orientation of FIG. 2.

FIG. 3 is the pouring spout 1, bottle neck 2 and capsule 3, 4 of FIG. 2 tilted from the orientation shown in FIG. 2. The tilting is therein continued so far that the bottle-neck 2 is situated lower than the other part of the bottle. Nevertheless, the cylinder member 7 still closes the openings 10 arranged in the cylindrical part 9 of the pouring spout 1. The cause thereof is a contact surface 20 which is situated on the inside of the pouring spout 1 and which diverges toward the cylindrical part 9. Subject to the divergence of this contact surface 20 there exists a limit angle $\alpha$ through which a bottle with pouring spout 1 can be tilted without the openings 10 being opened.

Figure 4:
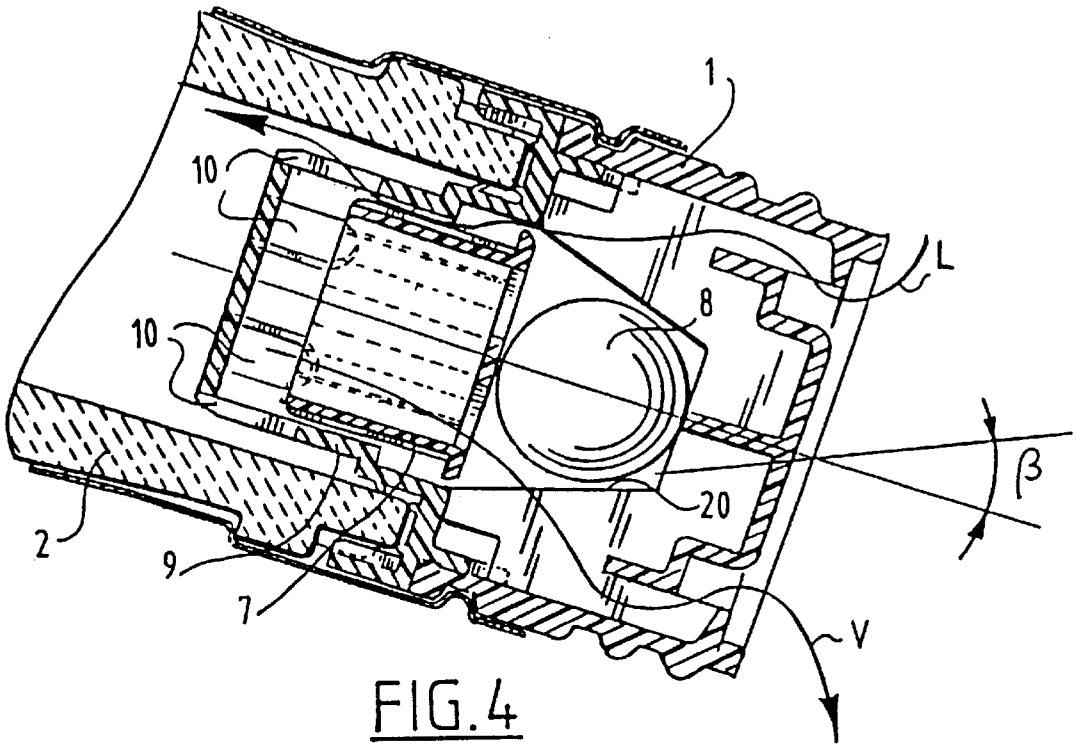
FIG. 4 is another view of the pouring spout of FIG. 2 tilted further than shown in FIG. 3.

FIG. 4 shows the pouring spout 1, bottle neck 2 and capsule 3, 4 of FIG. 3 tilted still further. That is, the angle $\beta$ is greater than the angle $\alpha$ shown in FIG. 3. The ball-shaped weight 8 has rolled over the contact surface 20 from the position shown in FIG. 3 to the top part of the pouring spout. The cylinder member 7 has then also shifted such that the openings 10 in the cylindrical part 9 of the pouring spout 1 are opened. Liquid situated in the bottle-neck can now flow through the pouring spout 1 as according to the arrow V through said openings 10 and the inside of the cylindrical part 9. To prevent a vacuum being created in the bottle, air can enter as according to the arrow L. Importantly the openings 10 are placed off-centre of the pouring spout 1. The central opening in the cylindrical part 9 is sufficiently large that the liquid flow V and the air flow L can simply pass each other. This all contributes toward considerably improving the pouring properties of the pouring spout 1 according to the invention relative to prior art pouring spouts.

Figure 5:
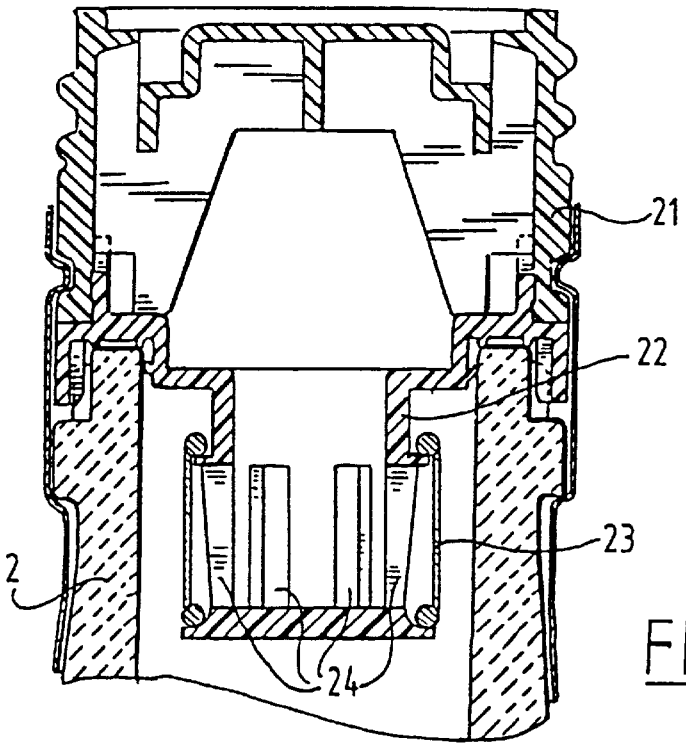
FIG. 5 is cross-sectional view of an alternative embodiment of a pouring spout according to the invention.

Finally, FIG. 5 shows an alternative pouring spout 21, a cylindrical part 22 which is externally surrounded by a cylinder member 23. Openings 24 are arranged in the cylindrical part 22. The cylindrical part 22 converges to a limited degree in the direction of the side facing toward the bottle-neck 2. The converging periphery of the cylindrical part 22 prevents the cylinder member 23 already beginning to move at a very small angle of inclination of the bottle relative to the horizontal plane. In this way the result is thus obtained, as already shown in FIG. 3, that at a position wherein the bottle-neck 2 is situated lower than the other part of the bottle the cylinder member 23 still closes the openings 24 in the cylindrical part 22 of the pouring spout 21. An advantage of this embodiment relative to the embodiment shown in the foregoing figures is that the ball-shaped weight 8 in the FIGS. 1–4 is omitted in this embodiment, whereby it does not act as an obstacle to the flow of liquid and air.

I claim:

1. A pouring spout with refill prevention device for an opening in a container, comprising:

a pouring spout housing having a hollow cylindrical part with at least one opening;

a hollow cylinder member which is displaceable in an axial direction relative to the hollow cylindrical part between a closing position in which the hollow cylinder member closes the at least one opening in the hollow cylindrical part and a pouring position in which the at least one opening in the hollow cylindrical part is left clear; and a movable weight positioned in the pouring spout housing displacing the hollow cylinder member between the closing position and the pouring position, wherein the inside of the pouring spout housing having a contact surface for the movable weight, with the contact surface diverging toward the hollow cylindrical part, and wherein the diverging contact surface and the movable weight maintain the hollow cylinder member in the closing position until the pouring spout housing is tilted to an angle greater than or equal to a slope of the contact surface.

2. The pouring spout with refill prevention device as claimed in claim 1, wherein the hollow cylindrical part is closed on one end side.

3. The pouring spout with refill prevention device as claimed in claim 2, wherein the hollow cylinder member is positioned inside the hollow cylindrical part of the pouring spout housing.

4. The pouring spout with refill prevention device as claimed in claim 2, wherein the hollow cylindrical part is provided with a plurality of openings defined in the periphery of the hollow cylindrical part.

5. The pouring spout with refill prevention device as claimed in claim 4, wherein the hollow cylinder member is positioned inside the hollow cylindrical part of the pouring spout housing.

6. The pouring spout with refill prevention device as claimed in claim 1, wherein the hollow cylinder member is positioned inside the hollow cylindrical part of the pouring spout housing.

7. The pouring spout with refill prevention device as claimed in claim 1, wherein the movable weight has the shape of a sphere.

8. The pouring spout with refill prevention device as claimed in claim 1, wherein the hollow cylinder member is positioned outside the hollow cylindrical part of the pouring spout housing.

9. The pouring spout with refill prevention device as claimed in claim 8, wherein the hollow cylinder member is weighted.

10. The pouring spout with refill prevention device as claimed in claim 8, wherein the outside of the hollow cylindrical part of the pouring spout housing converges toward a side of the container opposite the opening of the container.

11. The pouring spout with refill prevention device as claimed in claim 1, wherein a top side of the hollow cylinder member is provided with at least one grid bar preventing the movable weight from falling into the hollow cylinder member.

12. The pouring spout with refill prevention device as claimed in claim 1, wherein the hollow cylinder member includes guide ribs on the outside of the hollow cylinder member guiding the displacement of the hollow cylinder member relative to the hollow cylindrical part.

13. A pouring spout with refill prevention device for an opening in a container, comprising:

a pouring spout housing having a hollow cylindrical part, the hollow cylindrical part provided with a plurality of openings defined in the periphery of the hollow cylindrical part;

a hollow cylinder member which is displaceable in an axial direction relative to the hollow cylindrical part between a closing position in which the hollow cylinder member closes the openings in the hollow cylindrical part and a pouring position in which the openings in the hollow cylindrical part are left clear, the hollow cylinder member having guide ribs on the outside of the hollow cylinder member guiding the displacement of the hollow cylinder member relative to the hollow cylindrical part; and a movable weight positioned in the pouring spout housing displacing the hollow cylinder member between the closing position and the pouring position, wherein the inside of the pouring spout housing having a contact surface for the movable weight, with the contact surface diverging toward the hollow cylindrical part, and wherein the diverging contact surface and the movable weight maintain the hollow cylinder member in the closing position until the pouring spout housing is tilted to an angle greater than or equal to a slope of the contact surface.

14. The pouring spout with refill prevention device as claimed in claim 13, wherein the movable weight has the shape of a sphere.

15. The pouring spout with refill prevention device as claimed in claim 13, wherein the hollow cylinder member is positioned inside the hollow cylindrical part of the pouring spout housing.

16. The pouring spout with refill prevention device as claimed in claim 13, wherein the hollow cylinder member is positioned outside the hollow cylindrical part of the pouring spout housing.

17. The pouring spout with refill prevention device as claimed in claim 16, wherein the hollow cylinder member is weighted.

18. The pouring spout with refill prevention device as claimed in claim 16, wherein the outside of the hollow cylindrical part of the pouring spout housing converges toward a side of the container opposite the opening of the container.

* * * * *

UNITED STATES PATENT AND TRADEMARK OFFICE

CERTIFICATE OF CORRECTION

PATENT NO. : 5,924,606

DATED : July 20, 1999

INVENTOR(S) : Hendrik Gezinus Huizing

It is certified that error appears in the above-identified patent and that said Letters Patent is hereby corrected as shown below:

Title Page, under [22] delete "Filed: Apr. 29, 1997" and insert:
--PCT Filed: Sep. 14, 1995
[86] PCT No.: PCT/NL95/00307
§371 Date: Apr. 29, 1997
§102(e) Date: Apr. 29, 1997
[87] PCT Pub. No.: WO96/08421
PCT Pub. Date: Mar. 21, 1996--.

Title Page, under [56] References Cited, FOREIGN PATENT DOCUMENTS, "AP3639" should read --AP13639--.

Column 1 Line 66 after "includes" delete --comprises --.

Column 3 Line 14 "capsule 314" should read --capsule 3, 4--.

Signed and Sealed this

Twenty-third Day of May, 2000

*Attest:*

Q. TODD DICKINSON

*Attesting Officer*

*Director of Patents and Trademarks*